United States Patent [19]

Rojey et al.

[11] 4,368,779

[45] Jan. 18, 1983

[54] COMPACT HEAT EXCHANGER

[75] Inventors: Alexandre Rojey, Garches; Georges Cohen, Le Pecq, both of France

[73] Assignee: Institut Francais du Petrole, Rueil-Malmaison, France

[21] Appl. No.: 145,651

[22] Filed: May 2, 1980

[30] Foreign Application Priority Data

May 2, 1979 [FR] France ..... 79 11529

[51] Int. Cl.[3] ..... F28F 7/00

[52] U.S. Cl. ..... 165/165

[58] Field of Search ..... 165/164, 165, 179

[56] References Cited

U.S. PATENT DOCUMENTS

| | | | |
|---|---|---|---|
| 1,734,274 | 11/1929 | Schubart | 165/165 X |
| 1,863,586 | 6/1932 | Wilke | 165/165 |
| 2,926,490 | 3/1960 | Eaton et al. | 165/169 X |
| 3,272,260 | 9/1966 | Raub et al. | 165/164 |
| 3,409,075 | 11/1968 | Long | 165/154 |
| 3,491,184 | 1/1970 | Rietdijk | 165/165 X |
| 3,825,063 | 7/1974 | Cowans | 165/165 X |
| 4,096,910 | 6/1978 | Coffinberry et al. | 165/164 X |
| 4,107,919 | 8/1978 | Sokolowski | 165/169 |
| 4,147,210 | 4/1979 | Pronko et al. | 165/165 |

FOREIGN PATENT DOCUMENTS

| | | | |
|---|---|---|---|
| 263608 | 9/1970 | U.S.S.R. | 165/179 |

*Primary Examiner*—Sheldon J. Richter

*Attorney, Agent, or Firm*—Millen & White

[57] ABSTRACT

A heat exchanger composed of stacked perforated sheets forming two series of channels for at least two fluids, with a hot fluid and a cold fluid, the heat being transferred through the sheets. A distribution system is provided at each end and includes (a) a series of grooves communicating with an external duct, and (b) passages passing throughout a distribution plate and communicating with an external duct.

15 Claims, 23 Drawing Figures

COMPACT HEAT EXCHANGER

BACKGROUND OF THE INVENTION

The manufacture at low cost of large surface exchangers is essential to save energy by allowing increased heat recovery.

The conventional exchangers are of the tube and calender type. One of the fluids taking part to the exchange is passed through the tubes, while the other fluid taking part in the exchange is circulated around the tubes in the calendar. The exchange surface per unit volume, also called the specific surface, which can be obtained with such exchangers is usually low. As a matter of fact, for constructional reasons, it is not easy to reduce the diameter of the tubes and the distance or spacing between the tubes to less than 1 cm.

The plate exchangers can be used to obtain larger exchange specific surfaces. In these exchangers, the fluids taking part in the exchange circulate on each side of the plates. However, the specific surface in this type exchanger is also limited because the distance between the plates cannot be reduced too much.

Other prior art heat exchangers are known which consist of stacked perforated sheets, joined so as to obtain channels, by superposition of the perforations, with a relatively hot fluid being passed through certain ones of the channels, and a relatively cold fluid through other channels. Heat is transferred from channel to channel by conduction through the material forming at least one part of said sheets.

SUMMARY OF THE INVENTION

In accordance with the invention there is proposed a new improved heat exchange device with a high specific surface, which consists mainly of:

Stacked perforated sheets arranged so as to obtain, by superposition of the perforations, continuous channels forming a plurality of rows, each having a plurality of channels. Some of the channels forming passages for a relatively hot fluid and the others for a relatively cold fluid. At least a portion of said sheets are formed of a material capable of conducting heat under the conditions of use, and the heat transfer from one channel to another channel takes place by conduction through the heat conducting material forming at least part of said sheets; and At each end, a system for distributing and collecting the fluids, formed of at least one distribution plate and comprising (a) a series of slots, each of which covers a plurality of channels, with said slots communicating at one of their ends with an external duct, and (b) passages throughout said plate opening on channels on one side of the plate and on an external duct on the other side of the plate.

BRIEF DESCRIPTION OF THE DRAWINGS

The heat exchange device of the invention will be described below with reference to the accompanying drawings wherein.

DETAILED DISCUSSION OF THE INVENTION

The effective heat exchange zone is first described with reference to FIGS. 1 to 7.

Figure 1A:
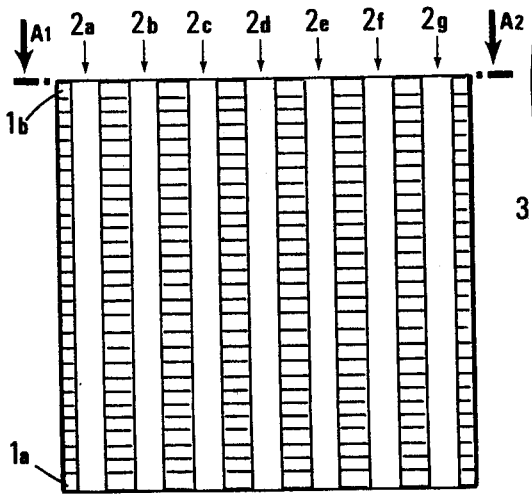
FIG. 1A is a schematic vertical cross-sectional view of the first embodiment of the heat exchange zone of the invention.
Figure 1B:
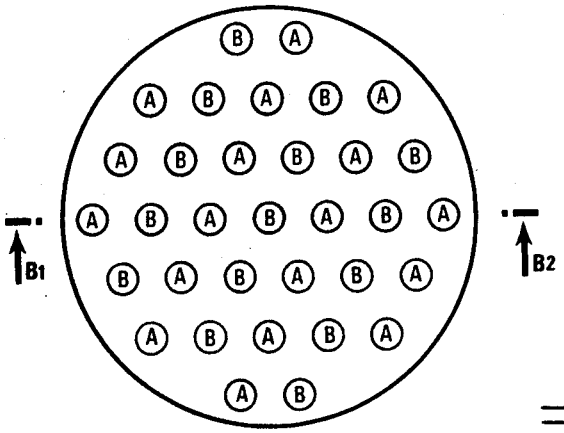
FIG. 1B is a schematic cross-sectional view along lines $A_1$–$A_2$ of FIG. 1A.

A particular embodiment of the exchange zone is shown as example in the FIGS. 1A and 1B.

In the first embodiment, each sheet forming the exchanger is provided with regularly distributed circular holes. When said perforated sheets are superposed, cylindrical channels are formed as shown in FIG. 1*a*, in vertical cross-section. In FIG. 1*a*, the first and the last stacked sheets are designated as 1*a* and 1*b*. The channels formed by the stacked sheets are designated as 2*a* to 2*g*. When the heat exchange takes place between a hot fluid A and a cold fluid B, the hot fluid and the cold fluid are passed through distinct groups of channels according to the arrangement of FIG. 1B, so that each channel traversed by one the fluids is located near, or in the vicinity of at least one channel traversed by the other fluid. This figure represents a cross sectional view of the exchanger along the plane $A_1$–$A_2$ of FIG. 1A. FIG. 1A represents the cross-section along the plane $B_1$–$B_2$ of FIG. 1B.

The channels may convey the hot or cold fluids taking part in the exchange, either co-currently or countercurrently, and it is possible to make more than two fluids participate to the heat exchange, by passing the different fluids participating in the exchange through distinct groups of channels.

The fluids participating to the exchange circulate in directions substantially transverse to the sheets which are contiguous.

The perforated sheets are preferably made of metal, for example, ordinary steel, such as steel A 37 C NFA 36205 according to the AFNOR standard, stainless steel such as steel Z6 CN 18-10 according to the AFNOR standard, aluminum, copper, monel, titanium or any other heat conducting material.

When the heat exchange is performed at a high temperature, the sheets may be made of refractory material, for example, ceramic.

The sheets may be maintained and secured to one another by the different techniques known as producing a sufficient adhesion of the sheets of the selected material. They can be secured with a fluid glue such as an epoxy adhesive, or heat-sealed with an impregnating agent, or brazed.

In a number of cases, it is desirable that the exchanger be capable of disassembly to facilitate cleaning optionally replacing of the elements. In that case, the sheets are not made to adhere to one another and are merely stacked.

Figure 2:
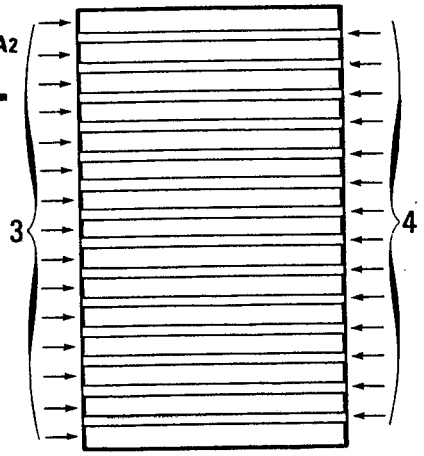
FIG. 2 is schematic illustration, from the exterior, of one embodiment of joint forming sheet employed in the invention, inserted between heat conducting sheets.

When full tightness is not required, the tightness from channel to channel may be obtained by a simple tightening of the stacked sheets. This tightness may be improved by inserting, between the heat conducting sheets, perforated sheets forming joints and consisting of a more deformable material, for example, an elastomer of the synthetic butyl or nitrile, or ethylene propylene rubber type, of the Neoprene or Viton type, Teflon or klingerite. In the case of an elastic material, the size of the holes is preferably slightly larger than that of the holes of the conducting sheets. For example, in the case of circular holes having a diameter of 3 mm for metal sheets, holes of a diameter of 4 mm can be selected for the joint forming sheets. The resultant arrangement is represented in FIG. 2 which shows how the joint forming sheets, designated by the arrows 4 and seen from the exterior, are inserted between the heat conducting sheets designated by the arrows 3.

Figure 3C:
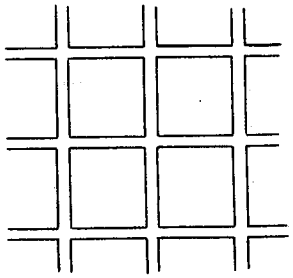
FIG. 3C is another representation as in FIGS. 3A and 3B, but with rectangular holes.
Figure 3D:
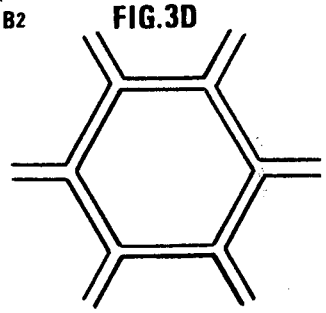
FIG. 3D is another arrangement as in FIG. 3C but with hexagonal holes.
Figure 3A:
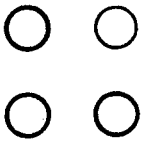
FIG. 3A is a representation of one arrangement of the holes in the perforated sheets.
Figure 3B:
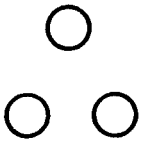
FIG. 3B is a representation of another arrangement of the holes in the perforated sheets.
Figure 3E:
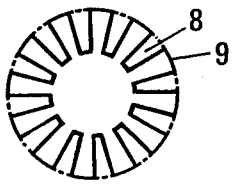
FIG. 3E shows the circular holes with inwardly extending ribs.

The circular holes may be arranged according to a periodical arrangement whose basic element, has the configuration of a square as shown in schematic form in FIG. 3*a*, or a triangle as in the schematic of FIG. 3*b*, the basic elements being regularly repeated so as to cover the perforated part of the sheets uniformly.

It is also possible to alternate holes of different diameters, so as to pass the fluids participating in the exchange in channels of different diameters, in order for example, to reduce the pressure drop by passing one of the fluids through the channels of larger diameter.

It is also possible to give the holes various shapes, for example, of a circle, a square, a rectangle or a hexagon. The stacked sheets thus form channels of circular, square, rectangular or hexagonal section. FIGS. 3C and 3D show examples of arrangements obtained respectively with holes of rectangular and hexagonal shape. It is thus possible to obtain very large perforated sections. For example, with square holes of an 8 mm width, separated by 1 mm, the perforated section amounts to 79%. Exchangers of large specific surface and low weight can thus be obtained.

It is also possible to provide each hole of a series with inwardly directed ribs. In the case of circular holes, the ribs may be arranged along radii of the circle constituted by the perimeter of the hole, as shown, for example, in the diagram of FIG. 3E.

Each of the ribs, for example the rib 8, is thus characterized by its height and the angle at the center of the delimiting radii. If, for example, the circle 9 constituted by the perimeter of the hole is divided into identical angular sectors, the ribs may be arranged so as to occupy only one of two sectors.

When the ribs are superposed, there are obtained channels provided with longitudinal ribs. If the channels where the hot and cold fluids participating in the heat exchange are passed have the same geometrical characteristics, the available exchange surface is practically equivalent to that obtained with a tube or plate exchanger whose exchange surface is the same as the total internal surface of the channels traversed by one of the fluids.

The exchange specific surface defined as the internal surface per unit volume of the exchanger, depends on the perforated fraction, the diameter of the holes, the number of ribs per hole and the height of the ribs. With a perforated fraction of 50%, holes of 8 mm diameter, and 18 ribs per hole of 2 mm height, there is obtained a specific surface of about 1200 $m^2/m^3$.

Non-circular holes may also be provided with ribs.

The perforated sheets which form the exchanger may vary in shape and size. They can be, for example, circular, rectangular or square.

When the perforated sheets are superposed, the sheets may be stacked according to different arrangements.

For example, when said sheets are circular, it is possible each time a new sheet is placed to rotate it at a constant angle about an axis passing through the center of the circle defined by the stacking of the sheets, so as to obtain a partial covering of the holes. Channels of helical shape are thus obtained, whereby the exchange surface is increased and a turbulence improving the heat transfer is induced by the free edges at the level of each hole.

Figure 4A:
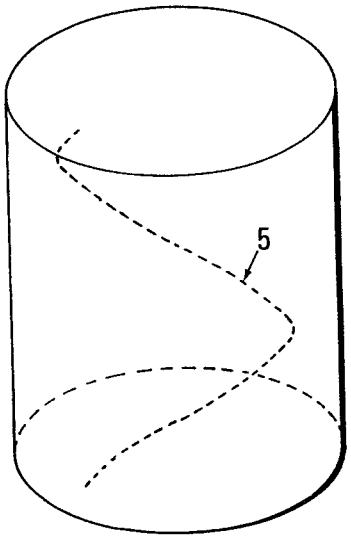
FIG. 4A illustrates a single channel in the exchanger when the perforations are arranged to overlap.
Figure 4B:
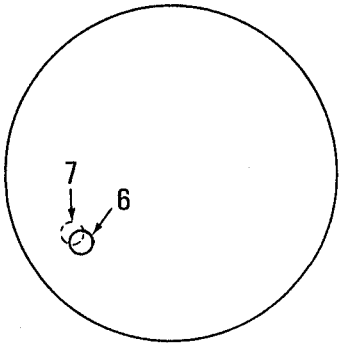
FIG. 4B illustrates a typical overlap of perforations of adjacent plates according to the invention.

Such a device is illustrated in FIGS. 4A and 4B. For example, FIG. 4A shows an arrangement which can be obtained for any channel designated with the arrow 5 when, in the case of an exchanger formed of n, number of sheets, each additional sheet, when positioned, is rotated by an angle of 360/n degrees. FIG. 4B shows how the holes are staggered when an additional sheet is positioned. The arrow 6 shows the hole corresponding to the exit of channel 5 through the last sheet of the stack (the upper sheet of the stack). The arrow 7 shows the position of the corresponding hole in the penultimate sheet of the stack and shows the staggering achieved when positioning two successive sheets.

If each hole is provided with ribs, this arrangement also provides for a displacement of the ribs each time an additional sheet is placed, so that a further increase of the specific exchange surface is obtained.

It is also possible to alternate sheets whose holes are of different shape or size, or arranged in different manner, so as to be staggered when the sheets are superposed.

Figure 5A:
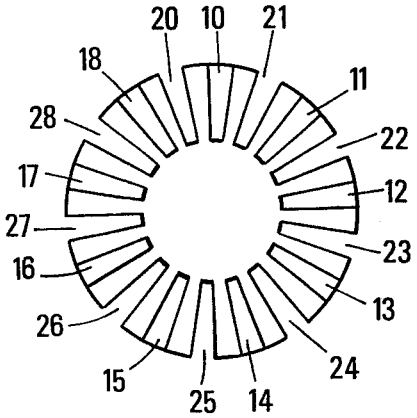
FIG. 5A illustrates two aligned perforations, each having ribs extending within the perimeter thereof.

It is also possible, for example, to superpose sheets whose holes are provided with ribs staggered as shown in FIG. 5A. The free sectors left between the ribs of a given sheet, and designated by the arrows 20 to 28 in FIG. 5A allow the ribs of the sheet located below in the stack to be open, these ribs being designated by the arrows 10 to 18 in FIG. 5A. The exchanger is thus formed of two types of alternate sheets with a different arrangement of the ribs. In this manner, each channel formed by superposition of the sheets is provided with ribs on its entire internal surface, each rib being fully surrounded with the fluid circulated in said channel, which provides for a very high specific exchange surface and increases the coefficients of heat transfer between the fluids participating in the exchange. The specific exchange surface thus obtained is the higher as the sheets are thinner, and the ratio of the hole diameter to the thickness of the sheets is preferably selected to be higher than 5.

It is also possible to alternate sheets whose holes are not provided with ribs with sheets whose holes are provided with ribs, or alternate sheets whose holes are provided with staggered ribs by inserting sheets whose holes have no ribs between the sheets whose holes are provided with staggered ribs.

It is clear that many arrangements with ribs of different shapes or size, or staggered in different manners are in accordance with the concept of the invention.

Figure 5B:
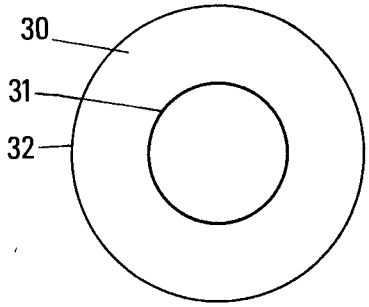
FIG. 5B illustrate two aligned perforations, one having a larger opening size than the other.

It is also possible to alternate sheets provided with holes of different size, as shown, for example, in FIG. 5B in the case of circular holes. In the case of the FIG. 5B, reference 32 designates the perimeter of a hole of large diameter superposed on a hole of smaller diameter whose perimeter is designated by reference 31. The channel obtained by superposing sheets with holes of low diameter, and sheets with holes of large diameter, the distance between the holes being maintained constant for all the sheets, is thus provided with circular ribs such as that shown with reference 30 in the diagram of FIG. 5B.

The exchanger according to the invention has also the advantage of being easily constructed and assembled.

The sheets forming the exchanger may be perforated according to different methods; mechanical, chemical or electrochemical methods. The perforation of the sheets, for example by punching, is the easier as the sheets are thinner; it is adapted to an extended automatization.

Figure 6A:
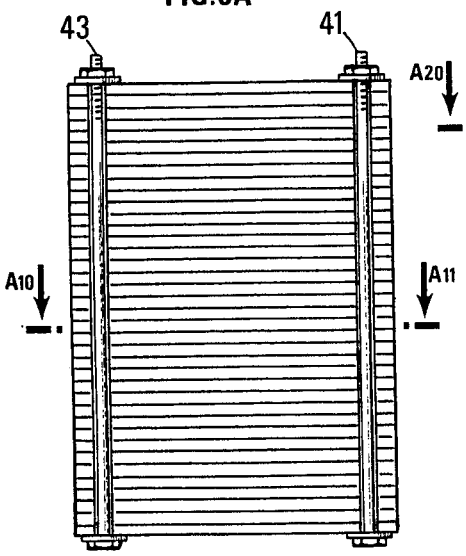
FIG. 6A is a side cross-section view illustrating one securing arrangement for the sheets of the exchanger.
Figure 7A:
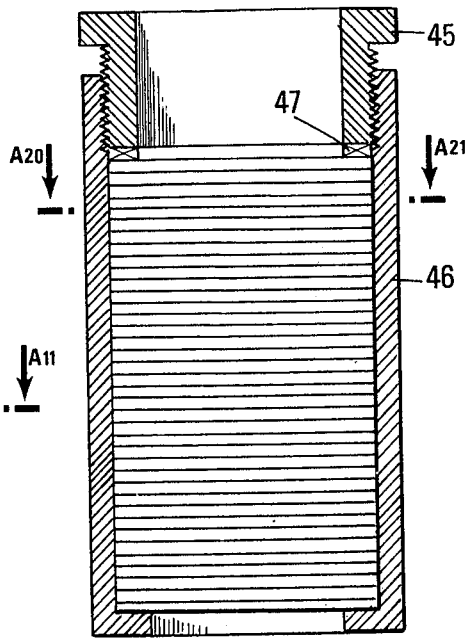
FIG. 7A is a side cross-section view showing an arrangement wherein the sheets are arranged in a shell.
Figure 6B:
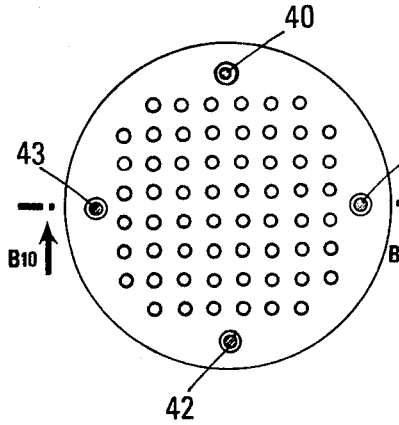
FIG. 6B is a top view thereof.
Figure 7B:
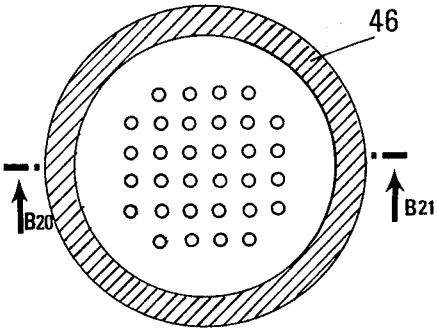
FIG. 7B is a top view thereof.

When the sheets forming the exchanger are not secured to one another but are merely superposed and tightened, the various known tightening methods may be used. This tightening may be achieved, for example, by means of rods threaded at their ends and bolted as shown in FIGS. 6A and 6B. In FIG. 6B showing a cross-section along the plane A10–A11 of FIG. 6A, these threaded rods are referenced 40, 41, 42 and 43. FIG. 6A shows a cross-section along the plane B10–B11 of FIG. 6B. It is also possible, as shown in FIGS. 7A and 7B, to place the sheets forming the exchanger in a shell, for example, the cylindrical shell 46 closed with the threaded piece 45. The piece 47 is a spring-forming deformable piece which must be used each time the sheets forming the exchanger and the shell are subjected to substantial differential thermal expansions. FIG. 7B represents the cross-section along the plane A20–A21 and FIG. 7A the cross-section along the plane B20–B21.

A particularly important feature of the exchanger according to the invention lies in the distributors and collectors for the fluids participating in the heat exchange. The exchanger according to the invention can be used to obtain a very large specific surface provided it has a large number of channels. It is essential that each of the fluids circulated through these channels and participating in the heat exchange be distributed and collected in a uniform manner and with a reduced pressure drop. This is particularly important in the case of gas-gas exchange.

According to the invention, the systems for distributing and collecting the fluids participating in the heat exchange, connected to each end of the effective exchange zone, may be defined generally as being formed of at least one distribution plate having:

(a)—a series of grooves, each of which covers a plurality of channels, said grooves communicating at one of their ends with an external duct, and (b)—passages throughout said plate, opening on channels on one side of the plate, and on an external duct on the other side of the plate.

This distribution device is of particular interest in the case of gas-gas exchanges. In the case of such exchanges, the distributing and collecting system must allow the input and output of the fluids participating in the exchange through ducts having a relatively substantial cross-sectional area with respect to the total cross-sectional area of the exchanger and must also provide for a reduction of the pressure drops.

Figure 8A:
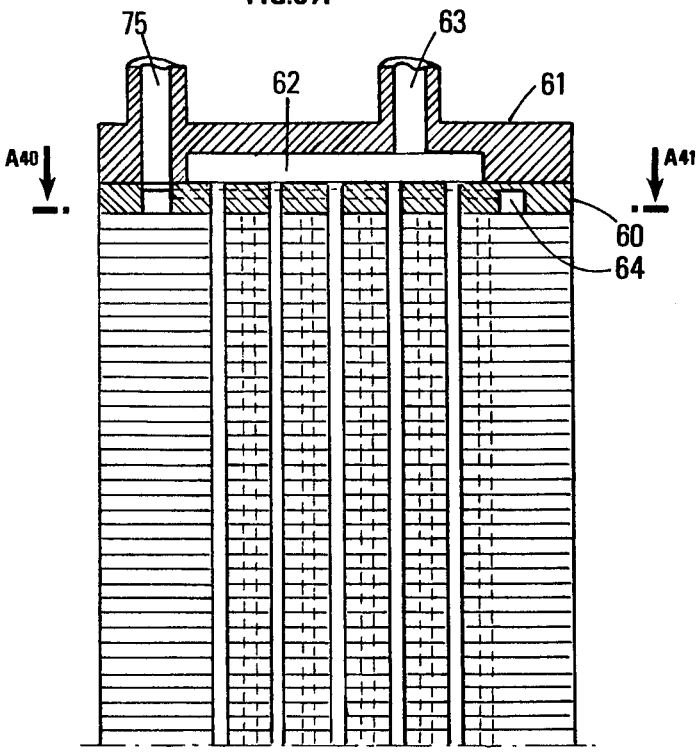
FIG. 8A is a cross-section side view illustrating one embodiment of the distribution system employed in the invention.
Figure 8B:
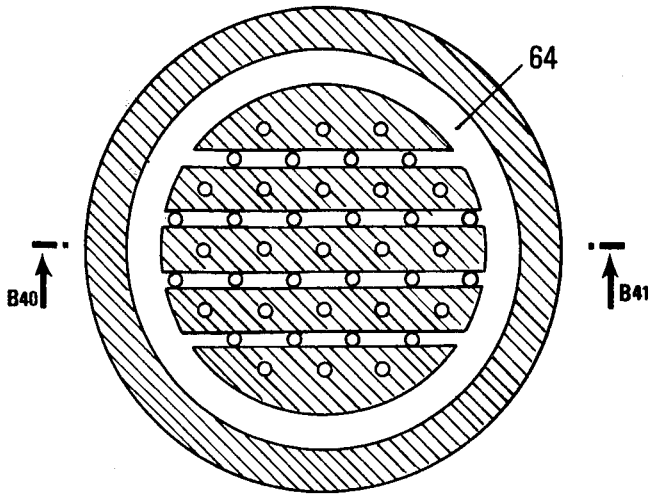
FIG. 8B is a view in section along line $A_{40}$–$A_{41}$ of FIG. 8A.

A particular embodiment of the distributing and collecting system for the fluids, according to the invention, is represented in FIGS. 8A and 8B. FIG. 8B represents a cross-section along the plane A40–A41 of FIG. 8A and FIG. 8A a cross-section along the plane B40–B41 of FIG. 8B.

The member 60 is a plate perforated with holes joining the channels through which one of the fluids participating in the exchange is fed to the chamber 62 arranged in the member 61, said chamber communicating with duct 63. The member 60 is provided with slots, joining the channels wherethrough passes the second fluid participating to the exchange to chamber 64 arranged in the member 60, said chamber communicating with duct 75. The fluids participating in the exchange may thus be fed or discharged through the ducts 63 and 75 by passing through the corresponding channels. The same device may be fit at the other end of the exchanger.

The same arrangement may be adapted to heat exchanges between several fluids. As a matter of fact, an intermediary plate of the same type as plate 60 may be adapted between members 61 and 60, so that a part of the channels communicates with chamber 62 and another part of the channels communicates with a chamber arranged in said intermediary plate communicating with a third external duct.

FIGS. 8A and 8B are given as examples, and the number, the size and the relative location of the different members, holes and grooves may largely differ.

It is possible, for example, to adapt the arrangements shown in FIGS. 8A and 8B to rectangular plates by joining the holes and grooves to rectangular instead of circular chambers. It is also possible to adapt these arrangements to holes of, for example, rectangular or hexagonal shape. Generally, any device providing communication between the channels wherethrough a given fluid is passed, and a chamber communicating with a feed or discharge duct may be used.

A particularly important application is the recovery of heat from the flue gas of a furnace or a boiler by pre-heating of air.

Figure 9A:
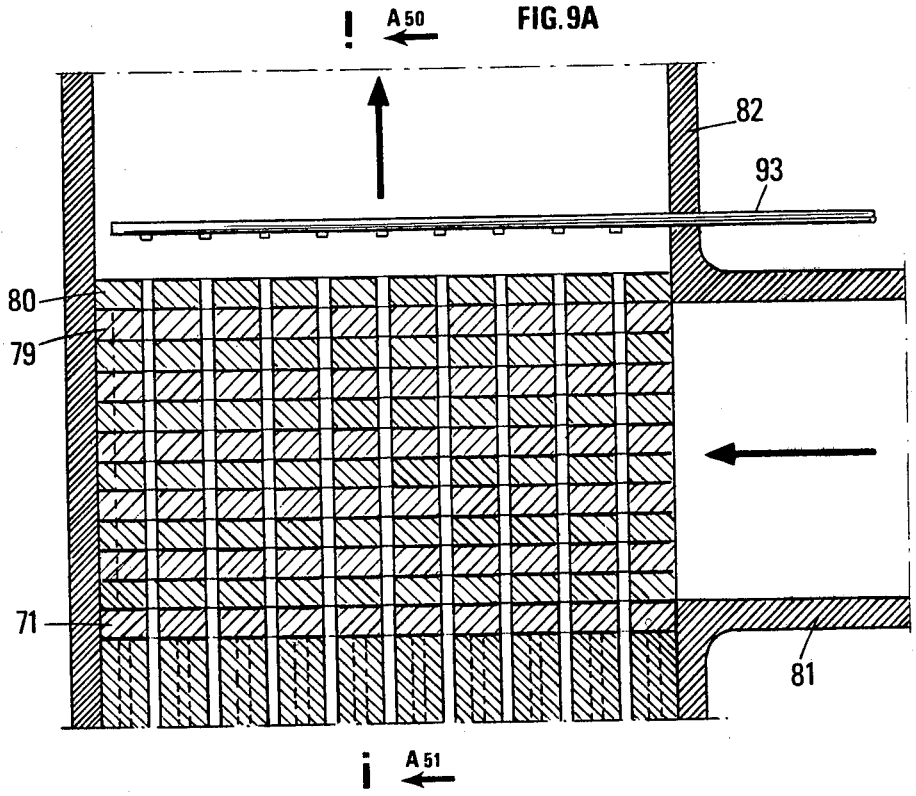
FIGS. 9A, 9B, and 9C respectively illustrate a side cross-section, top section along line $A_{50}$ of FIG. 9A, and over all diagramatic view of the arrangement for use in the recovery of heat from flue gas.
Figure 9B:
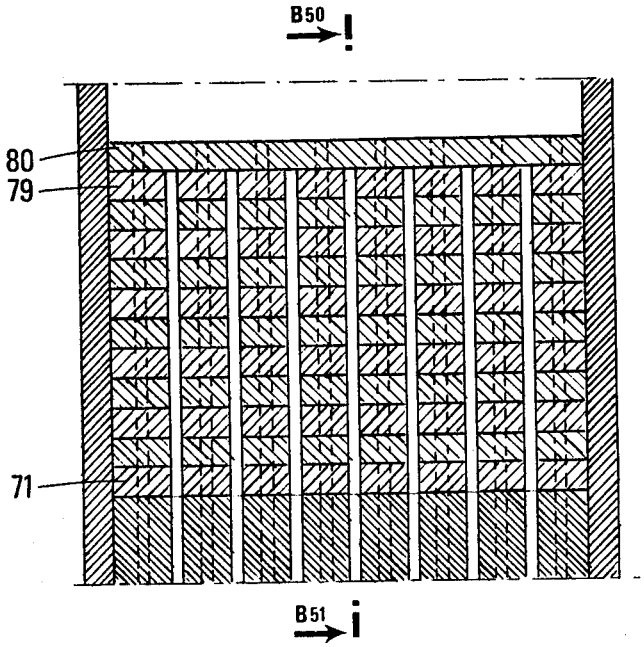
Figure 9C:
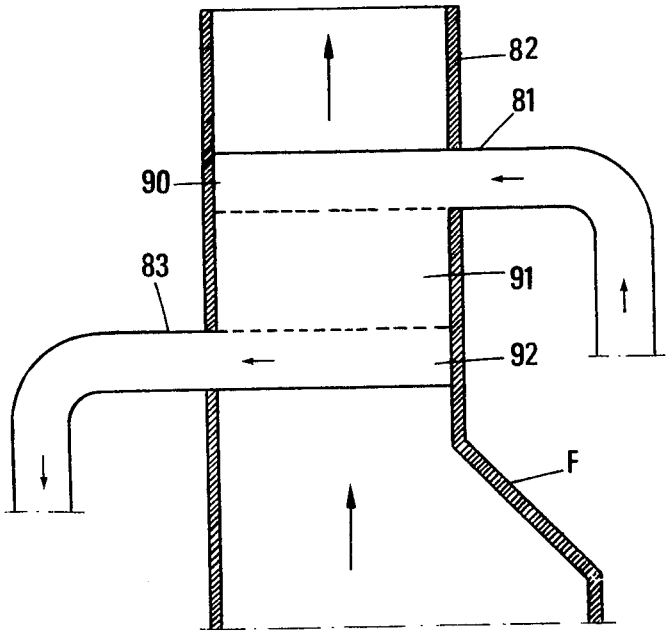

An example of arrangement which can be adopted in that case is shown in FIGS. 9A, 9B and 9C. FIG. 9B is a cross-sectional view along plane A50–A51 of FIG. 9A and FIG. 9A is a cross-sectional view along plane B50–B51 of FIG. 9B.

The distribution system comprises 12 plates at each end in the case shown in FIGS. 9A and 9B. The plates 71 to 79 comprise perforations which, when superposed, form channels communicating with the channels fed with fresh air from the duct 81. The slots of plates 71 to 79 extend up to the edge on the fresh air input and communicate with this air which is supplied through duct 81. On the opposite end, these slots are discontinued before the edge of the plate, so as to ensure tightness of the exchanger. The plate 80 comprises apertures wherethrough the flue gas can directly pass into the chimney duct 82.

The exchanger comprises a symmetrical arrangement at the other end of the exchanger. The overall arrangement is diagrammatically shown in FIG. 9C. The flue gas discharged from the convection zone of the furnace F directly passes through the vertical channels of the distribution zone 92, and then through the channels corresponding to the passage of the flue gas in the exchange zone 91 and finally through the channels of the distribution zone 90.

Fresh air is supplied through duct 81 and distributed through the slots of the distribution zone 90; it passes through the corresponding channels in the exchange zone 91 and through the grooves of the distribution zone 92 and is discharged through duct 83 on the side opposite to the opening of duct 81. The plate 80 has no opening above the slots of the plate 79. The superposition of the plate 80 and the plates 71 to 79 thus provides grooves through which fresh air is laterally admitted.

The distribution zone 92 comprises, just as the distribution zone 90, channels corresponding to the passage of the flue gas and grooves allowing lateral discharge of the preheated air, these grooves being however, open on the side opposite to the fresh air input, while the grooves of zone 90 are necessarily open on the side of the fresh air supply.

By discharging the fresh air on the side opposite to the admission, it is possible to equalize the pressure drops and to distribute fresh air through all the channels uniformly.

The arrangement shown in the FIGS. 9A, 9B and 9C provides for a maximum reduction of the pressure drop relative to the flue gas and a limitation of the fouling by avoiding dead zones. It also provides for easy maintenance and cleaning.

It is thus possible to provide a cleaning ramp, such as the ramp 93 shown in FIG. 9A to periodically inject water through the channels used for the flue gas, during the periods of shutdown and maintenance.

Fouling may also be reduced by blowing air through the exchanger at a pressure higher than the pressure of the flue gas and by accepting slight air leakage between the plates, optionally by providing the plates with grooves, so as to remove from the walls the particles which tend to settle thereon.

Figure 10A:
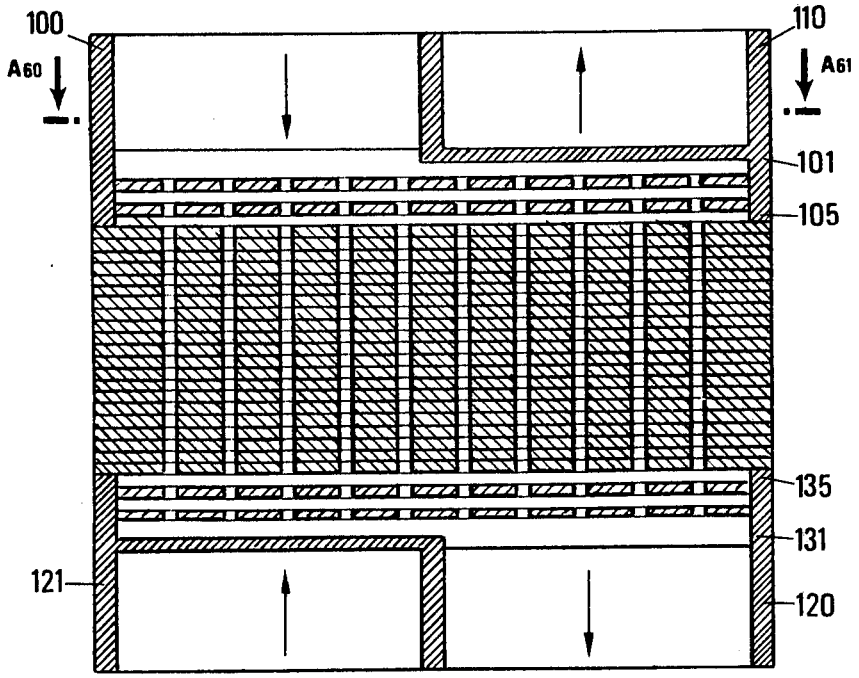
FIG. 10A is a side cross-section view of another embodiment of the distribution system.
Figure 10B:
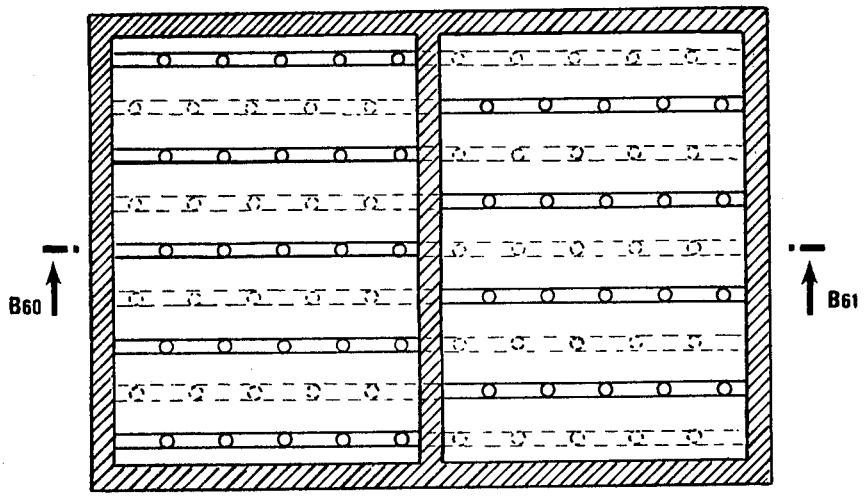
FIG. 10B is a top section view along line $A_{60}$–$A_{61}$ of FIG. 10A.

Another example of the preferred distributing and collecting system is shown in FIGS. 10A and 10B. FIG. 10B is a cross-sectional view along the plane A60–A61 of FIG. 10A and FIG. 10A a cross-sectional view along the plane B60–B61 of FIG. 10B.

Such an arrangement may be suitable, for example, for air-air exchanges, particularly in the case of ventilation, to recover heat from the air extracted from the ventilated enclosure.

A first fluid participating in the exchange is fed through duct 100. It is distributed through the device formed of the plates 101 to 105. The plate 101 comprises, as shown in FIG. 10B, a series of slots for feeding the fluid fed from duct 100 to the corresponding channels. These slots are extended by grooves to distribute the fluid fed from duct 100 to the channels facing duct 110 for discharge of the second fluid participating in the exchange, while isolating said channels from this second fluid.

The other plates of the distribution zone are provided alternatively with slots and holes. The plates provided with holes have as an object to improve the distribution of the fluids through the different channels and to increase the exchange surface in the distribution zone.

The plate 100 also has a series of slots wherethrough the fluid discharged from duct 110 communicates with corresponding channels. These slots are extended by grooves for collecting the fluid which is discharged from duct 110 through channels facing duct 100.

Each of the fluids passes through the central part of the exchanger in the corresponding channel rows. The fluid fed from duct 100 is discharged through duct 120 and the fluid discharged from duct 110 is fed through duct 121. The distribution system formed of the plates 131 to 135 is symmetrical to the distribution system formed of the plates 101 to 105.

The exchanger according to the invention may be built in quite different sizes ranging, for example, from about ten centimeters to several meters. The sheets constituting the exchanger have a thickness of, for example, 50$\mu$ to 5 mm. The size of the holes defined as the greatest distance between two points on the perimeter of a hole is, for example, from 0.5 to 50 mm and the perforated fraction is, for example, from 40 to 95%.

What we claim is:

1. A heat exchanger of high specific surface comprising:

a body made up of a plurality of stacked perforated sheets, each of said stacked perforated sheets having at least a portion thereof comprised of heat-conducting material, and arranged in a manner such that the perforations of each of said sheets are superposed to define continuous channels, whereby first and second fluids trasmitted through the heat exchanger to participate in a heat exchange are circulated respectively through said channels;

ribs extending within the perimeter of at least some of the perforations in the sheets, and said ribs comprising a series of spaced solid sections comprised of the heat-conducting material of said sheets to thereby provide an increased specific contact area with said first and second fluids circulating therethrough; and respective inlet and outlet distribution systems associated with said continuous channels for circulating said first and second fluids into and out of their respective heat exchanger channels.

2. A heat exchanger according to claim 1, wherein the stacked sheets are maintained in place by tightening means.

3. A heat exchanger according to claim 1, wherein the heat-conducting perforated sheets are maintained bound together by means of a material providing mutual adhesion.

4. A device according to claim 1 wherein the perforations in the sheets forming the exchanger are circular in shape.

5. A heat exchanger according to claim 1, wherein each of the sheets is located at a position rotated about an axis perpendicular to the sheets, with respect to the preceding sheet, so as to obtain a partial covering of each of the perforations thereof.

6. A heat exchanger according to claim 1, further comprising sheets having perforations provided with ribs extending within the perimeter thereof, and arranged in alternance with sheets having perforations free of ribs.

7. A heat exchanger according to claim 1, wherein the sheets making up the exchanger have a thickness of from 50μ to 5 mm.

8. A heat exchanger according to claim 1, wherein the greatest distance between two points on the perimeter of a perforation is from 0.5 to 50 mm.

9. A heat exchanger according to claim 1, wherein the perforated fraction of each sheet forming the exchanger comprises from 40 to 95% of the sheet surface.

10. A heat exchanger according to claim 1, wherein the perforations of adjacent sheets are of different shapes.

11. A heat exchanger according to claim 1, wherein the ribs of adjacent perforations are arranged so as to alternate with respect to each other.

12. A heat exchanger according to claim 1, further comprising a watering ramp for periodically cleaning the channels fed with at least one of the fluids participating in the heat exchange.

13. A heat exchanger of high specific performance comprising a body made up of a plurality of stacked perforated sheets, each of said stacked perforated sheets having at least a portion thereof comprised of heat conducting material, and arranged in a manner such that the perforations of each of said sheets are superposed to define continuous channels, whereby first and second fluids transmitted through the heat exchanger to participate in a heat exchange are circulated respectively through said channels, and first and second distribution systems located at each end of the heat exchanger comprising several stacked sheets provided with rows of perforations and longitudinal slots open on one edge of the sheets for distributing or discharging the first and second fluids into or out of their respective channels, and at least one sheet associated, with each distribution system at each end, closed to said slots for preventing mixing of the first and second fluids through said slots.

14. A heat exchanger according to claim 13, wherein the first fluid participating in the exchange, comprises a flue gas discharged from a furnace, which is directly passed through the corresponding channels of the two distribution systems, and wherein a second fluid participating in the exchange, comprises fresh air, and is supplied through the grooves of the distribution system located at the second fluid inlet, and is discharged through the grooves of the distribution system located at the second fluid outlet, the grooves of said distribution systems opening on opposite sides of the exchanger.

15. A heat exchanger of high specific performance comprising a body made up of a plurality of stacked perforated sheets, each of said stacked perforated sheets having at least a portion thereof comprised of heat conducting material, and arranged in a manner such that the perforations of each of said sheets are superposed to define continuous channels, whereby first and second fluids transmitted through the heat exchanger to participate in a heat exchange are circulated respectively through said channels, and comprising at one end a first distribution system made up of several stacked sheets provided with a first series of slots for distributing or discharging the first fluid into or out of the channels corresponding thereto, and a second series of slots for distributing or discharging said second fluid into or out of the channels corresponding thereto, and at least one sheet of the first distribution system being closed to the first series of slots and open to the second series of slots on a half-section corresponding to the circulation of said second fluid, and open to the first series of slots and closed to the second series of slots on a half-section corresponding to the circulation of said first fluid, the halves of said sheets closed with respect to one group of channels and open with respect to the other group defining grooves with the other sheets of the distribution systems, and a second distribution system like said first distribution system located at the other end of the heat exchanger with a half section of the second distribution system open to the circulation of the second fluid located opposite the half section of the first distribution system open to the circulation of the first fluid, and a half section of the first fluid located opposite to the half-section of the first distribution system open to the circulation of the second fluid.

* * * * *